US008262510B2

(12) United States Patent
Sullivan et al.

(10) Patent No.: US 8,262,510 B2
(45) **Date of Patent: *Sep. 11, 2012**

(54) GOLF BALL WITH AN IONOMERIC INNER COVER, STIFF TPU INTERMEDIATE COVER, AND CAST THERMOSET OUTER COVER

(75) Inventors: Michael J. Sullivan, Barrington, RI (US); Brian Comeau, Berkley, MA (US); Mark L. Binette, Mattapoisett, MA (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 529 days.

This patent is subject to a terminal disclaimer.

(21) Appl. No.: 12/403,703

(22) Filed: Mar. 13, 2009

(65) Prior Publication Data

US 2010/0234139 A1 Sep. 16, 2010

(51) Int. Cl.
*A63B 37/06* (2006.01)

(52) U.S. Cl. ..... 473/376

(58) Field of Classification Search ..... 473/376
See application file for complete search history.

(56) References Cited

U.S. PATENT DOCUMENTS 5,334,673 A 8/1994 Wu
5,484,870 A 1/1996 Wu
5,530,083 A 6/1996 Phelps et al.
5,863,627 A 1/1999 Szycher et al.
6,056,650 A 5/2000 Yamagishi et al.
6,117,025 A * 9/2000 Sullivan ..... 473/373
6,129,640 A 10/2000 Higuchi et al.
6,135,898 A 10/2000 Higuchi et al.
6,152,834 A 11/2000 Sullivan
6,231,460 B1 5/2001 Higuchi et al.
6,394,914 B1 5/2002 Sullivan
6,506,851 B2 1/2003 Wu
6,561,928 B2 5/2003 Binette et al.
6,685,579 B2 2/2004 Sullivan
6,685,580 B2 2/2004 Sullivan
6,705,956 B1 3/2004 Moriyama et al.
6,736,737 B2 5/2004 Higuchi et al.
6,739,987 B2 5/2004 Harris et al.
6,743,122 B2 6/2004 Hayashi et al.
6,835,794 B2 12/2004 Wu et al.
6,855,074 B2 2/2005 Kato
6,855,793 B2 2/2005 Harris et al.
6,872,774 B2 3/2005 Sullivan et al.
6,910,974 B2 6/2005 Watanabe
6,966,849 B2 11/2005 Kato
7,005,479 B2 2/2006 Morgan et al.
7,037,217 B2 5/2006 Harris et al.
7,131,915 B2 11/2006 Sullivan et al.
7,331,878 B2 2/2008 Boehm et al.
7,358,305 B2 4/2008 Rajagopalan
7,427,243 B2 9/2008 Sullivan
2002/0151380 A1* 10/2002 Sullivan ..... 473/354
2004/0235587 A1* 11/2004 Sullivan et al. ..... 473/371

* cited by examiner

*Primary Examiner* — Raeann Gorden
(74) *Attorney, Agent, or Firm* — William B. Lacy

(57) ABSTRACT

A golf ball includes a core and a cover disposed adjacent the core. The cover includes a thermoplastic inner cover layer having a hardness between 55 and 60 Shore D; an outer cover layer having a hardness between 55 and 60 Shore D; and a non-ionomeric thermoplastic polyurethane or polyurea intermediate cover layer disposed between the inner and outer cover layers. The intermediate cover layer has a hardness greater than the inner cover layer hardness and the outer cover layer hardness. The inner cover is formed from a partially- or fully-neutralized ionomer and the outer cover layer is formed from a polyurethane, a polyurea, or a urethane-urea blend.

14 Claims, 1 Drawing Sheet

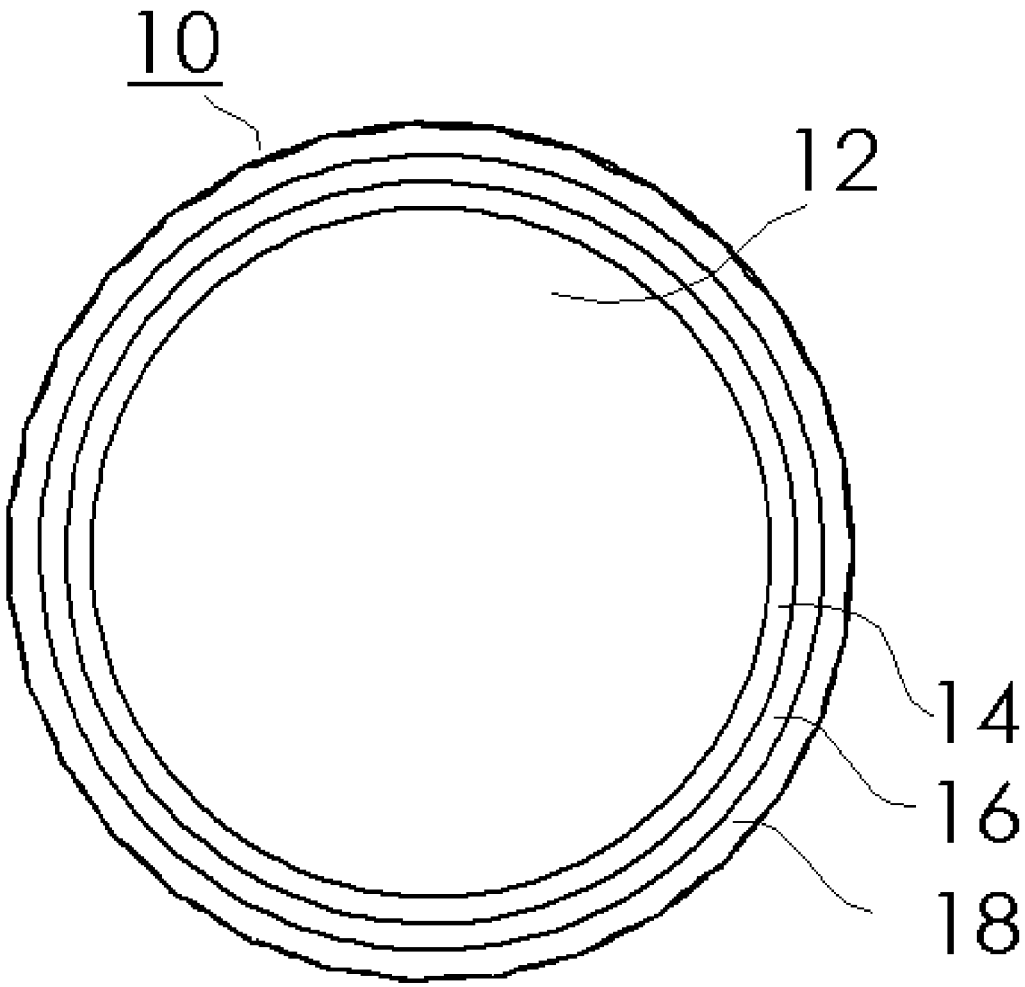
10
12
14
16
18

GOLF BALL WITH AN IONOMERIC INNER COVER, STIFF TPU INTERMEDIATE COVER, AND CAST THERMOSET OUTER COVER

FIELD OF THE INVENTION

This invention relates generally to golf balls, and more specifically, to a golf ball having a cover including at least three layers, the intermediate cover layer being formed from a thermoplastic polyurethane or polyurea material.

BACKGROUND OF THE INVENTION

The majority of golf balls commercially available today are of a solid construction. Solid golf balls include one-piece, two-piece, and multi-layer golf balls. One-piece golf balls are inexpensive and easy to construct, but have limited playing characteristics and their use is, at best, confined to the driving range. Two-piece golf balls are generally constructed with a solid polybutadiene core and a cover and are typically the most popular with recreational golfers because they are very durable and provide good distance. These golf balls are also relatively inexpensive and easy to manufacture, but are regarded by top players as having limited playing characteristics. Multi-layer golf balls are comprised of a solid core and a cover, either of which may be formed of one or more layers. These balls are regarded as having an extended range of playing characteristics, but are more expensive and difficult to manufacture than are one- and two-piece golf balls.

Wound golf balls, which typically included a fluid-filled center surrounded by a layer of tensioned elastomeric material and a cover, were preferred for their spin and "feel" characteristics but were more difficult and expensive to manufacture than solid golf balls. Manufacturers are continuously striving to produce a solid ball that concurrently includes the beneficial characteristics of a wound ball.

Golf ball playing characteristics, such as compression, velocity, and spin can be adjusted and optimized by manufacturers to suit players having a wide variety of playing abilities. For example, manufacturers can alter any or all of these properties by changing the materials and/or the physical construction of each or all of the various golf ball components (i.e., centers, cores, intermediate layers, and covers). Finding the right combination of core and layer materials and the ideal ball construction to produce a golf ball suited for a predetermined set of performance criteria is a challenging task.

Efforts to construct a multi-layer golf ball have generally focused on the use of one or two cover layers formed of ionomeric and/or polyurethane compositions. It is desirable, therefore, to construct a golf ball formed of a urethane or urea outer cover layer, at least two interior cover layers, and at least one core layer, according to the present invention. In particular, it is desired that this construction include a stiff, thermoplastic polyurethane or polyurea intermediate cover layer in conjunction with a stiff, resilient thermoplastic inner cover layer and thermosetting castable outer cover layer.

SUMMARY OF THE INVENTION

The present invention is directed to a golf ball including a core and a cover disposed adjacent the core. The cover includes a thermoplastic inner cover layer disposed about the core and having a hardness between 55 and 60 Shore D; an outer cover layer having a hardness between 55 and 60 Shore D; and a non-ionomeric thermoplastic polyurethane or polyurea intermediate cover layer disposed between the inner and outer cover layers. The intermediate cover layer has a hardness greater than the inner cover layer hardness and the outer cover layer hardness. The inner cover is formed from a partially- or fully-neutralized ionomer and the outer cover layer is formed from a polyurethane, a polyurea, or a urethane-urea blend.

In one embodiment, the intermediate layer hardness is greater than the inner cover layer hardness and greater than the outer cover layer hardness by at least 5 Shore D, more preferably by at least 10 Shore D. In another embodiment, the intermediate layer hardness is 60 Shore D or greater, more preferably 75 Shore D or greater, most preferably from 80 Shore D to 90 Shore D.

The polyurethane, polyurea, or urethane-urea blend is preferably a castable thermoset or reaction injection moldable thermoset. The outer cover typically is formed from a castable thermoset polyurea, the inner cover layer comprises an ionomer blend of two or more ionomers having differing metal cations, and the intermediate cover layer comprises a polycarbonate-polyurethane, a polycarbonate-polyurea, or a polycarbonate blend with polyurethane or polyurea.

The core may include a center and at least one outer core layer. Preferably, the core and/or center (in a dual core construction) is a single solid layer formed from a single, homogeneous composition. The non-ionomeric thermoplastic polyurethane or polyurea intermediate layer may also be blended with a polyolefin, a polyamide, or an acrylonitrile-butadiene-styrene polymer.

In one embodiment, the outer cover may include a thermoplastic polyurethane, the inner cover layer is formed from an ionomer blend of two or more ionomers having differing metal cations, and the intermediate cover layer includes at least one thermoplastic silicone-polyurethane or thermoplastic silicone-polyurea. The thermoplastic inner cover layer may further include polyolefins, metallocenes, polyesters, polyamides, thermoplastic elastomers, copolyether-amides, copolyether-esters, or mixtures thereof.

In an alternative embodiment, a combination of the inner cover, the intermediate cover, and the outer cover have a total thickness of 0.125 inches or less, more preferably 0.115 inches or less. The outer cover layer hardness is preferably less than the inner cover layer hardness.

The present invention is also directed to a golf ball comprising a core and a cover disposed adjacent the core. The cover includes an ionomeric thermoplastic inner cover layer disposed about the core and having a hardness of 55 Shore D to 60 Shore D; a castable thermoset outer cover layer having a hardness between 55 Shore D and 60 Shore D; and a non-ionomeric thermoplastic intermediate cover layer disposed between the inner and outer cover layers. The intermediate layer has a hardness greater than the inner cover layer and the outer cover layer. The inner cover layer also has a first thickness, the outer cover layer has a second thickness, and the intermediate cover layer has a third thickness less than the first or second thickness by at least 20%.

The present invention is further directed to a golf ball including a core and a cover disposed adjacent the core. The cover includes an ionomeric thermoplastic inner cover layer disposed about the core and having a hardness of 55 Shore D to 60 Shore D; a castable thermoset polyurethane outer cover layer having a hardness between 55 Shore D and 60 Shore D; and a non-ionomeric thermoplastic polycarbonate-polyurethane or polycarbonate-polyurea intermediate cover layer disposed between the inner and outer cover layers. The intermediate layer has a hardness greater than the inner cover layer and the outer cover layer. Additionally, the inner cover layer has a first thickness, the outer cover layer has a second thickness, and the intermediate cover layer has a third thickness less than the first or second thickness by at least 20%. Preferably, the intermediate layer hardness is greater than 60 Shore D, more preferably greater than 75 Shore D.

BRIEF DESCRIPTION OF THE DRAWINGS

These and other aspects of the present invention may be more fully understood with reference to, but not limited by, the following drawings.

FIG. 1 is a representative cross section of a golf ball of the invention.

DETAILED DESCRIPTION OF THE INVENTION

A golf ball of the present invention includes a core and a cover comprising an outer cover and at least two inner cover layers, such as an inner cover layer and an intermediate cover layer disposed between the outer cover layer and the inner cover layer. The golf ball cores of the present invention may be formed with a variety of constructions. For example, the core may include a plurality of layers, such as a center and an outer core layer. The core, while preferably solid, may comprise a liquid, foam, gel, or hollow center. The golf ball may also include a layer of tensioned elastomeric material, for example, located between the core and triple cover. In a preferred embodiment, the core is a solid core.

Materials for solid cores include compositions having a base rubber, a filler, an initiator agent, and a crosslinking agent. The base rubber typically includes natural or synthetic rubber, such as polybutadiene rubber. A preferred base rubber is 1,4-polybutadiene having a cis-structure of at least 40%. Most preferably, however, the solid core is formed of a resilient rubber-based component comprising a high-Mooney-viscosity rubber and a crosslinking agent.

Another suitable rubber from which to form cores of the present invention is trans-polybutadiene. This polybutadiene isomer is formed by converting the cis-isomer of the polybutadiene to the trans-isomer during a molding cycle. Various combinations of polymers, cis-to-trans catalysts, fillers, crosslinkers, and a source of free radicals, may be used. A variety of methods and materials for performing the cis-to-trans conversion have been disclosed in U.S. Pat. Nos. 6,162,135; 6,465,578; 6,291,592; and 6,458,895, each of which are incorporated herein, in their entirety, by reference.

Additionally, without wishing to be bound by any particular theory, it is believed that a low amount of 1,2-polybutadiene isomer ("vinyl-polybutadiene") is preferable in the initial polybutadiene to be converted to the trans-isomer. Typically, the vinyl polybutadiene isomer content is less than about 7 percent, more preferably less than about 4 percent, and most preferably, less than about 2 percent.

Fillers added to one or more portions of the golf ball typically include processing aids or compounds to affect rheological and mixing properties, the specific gravity (i.e., density-modifying fillers), the modulus, the tear strength, reinforcement, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents, zinc carbonate, regrind (recycled core material typically ground to about 30 mesh or less particle size), high-Mooney-viscosity rubber regrind, and the like. Polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or any or all core and cover layers, if present.

The initiator agent can be any known polymerization initiator which decomposes during the cure cycle. Suitable initiators include peroxide compounds such as dicumyl peroxide, 1,1-di(t-butylperoxy) 3,3,5-trimethyl cyclohexane, a-a bis(t-butylperoxy) diisopropylbenzene, 2,5-dimethyl-2,5 di(t-butylperoxy) hexane or di-t-butyl peroxide and mixtures thereof.

Crosslinkers are included to increase the hardness and resilience of the reaction product. The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel. Preferred acrylates include zinc acrylate, zinc diacrylate, zinc methacrylate, and zinc dimethacrylate, and mixtures thereof.

The crosslinking agent must be present in an amount sufficient to crosslink a portion of the chains of polymers in the resilient polymer component. This may be achieved, for example, by altering the type and amount of crosslinking agent, a method well-known to those of ordinary skill in the art.

When the core is formed of a single solid layer comprising a high-Mooney-viscosity rubber, the crosslinking agent is present in an amount from about 15 to about 40 parts per hundred, more preferably from about 30 to about 38 parts per hundred, and most preferably about 37 parts per hundred.

In another embodiment of the present invention, the core comprises a solid center and at least one outer core layer. When the optional outer core layer is present, the center preferably comprises a high-Mooney-viscosity rubber and a crosslinking agent present in an amount from about 10 to about 30 parts per hundred of the rubber, preferably from about 19 to about 25 parts per hundred of the rubber, and most preferably from about 20 to 24 parts crosslinking agent per hundred of rubber. Suitable commercially-available polybutadiene rubbers include, but are not limited to, CB23, CB22, Taktene® 220, and Taktene® 221, from Lanxess Corp.; Neodene® 40 and Neodene® 45 from Karbochem Ltd.; LG1208 from LG Corp. of Korea; and Cissamer® 1220 from Basstech Corp. of India. Other rubbers, such as butyl rubber, chloro or bromyl butyl rubber, styrene butadiene rubber, or trans polyisoprene may be added to the polybutadiene for property or processing modification.

Additionally, the unvulcanized rubber, such as polybutadiene, typically has a Mooney viscosity of between about 40 and about 80, more preferably, between about 40 and about 60, and most preferably, between about 40 and about 55. Mooney viscosity is typically measured according to ASTM D-1646.

The polymers, free-radical initiators, filler, crosslinking agents, and any other materials used in forming either the golf ball center or any portion of the core, in accordance with invention, may be combined to form a mixture by any type of mixing known to one of ordinary skill in the art. Suitable types of mixing include single pass and multi-pass mixing, and the like. The crosslinking agent, and any other optional additives used to modify the characteristics of the golf ball center or additional layer(s), may similarly be combined by any type of mixing. A single-pass mixing process where ingredients are added sequentially is preferred, as this type of mixing tends to increase efficiency and reduce costs for the process. The preferred mixing cycle is single step wherein the polymer, cis-to-trans catalyst, filler, zinc diacrylate, and peroxide are added sequentially.

The cover of the golf ball is a multi-layer cover, preferably comprised of at least three layers, such as an inner cover layer, an intermediate cover layer, and an outer cover layer. While the various cover layers of the present invention may be of any individual thickness, it is preferred that the combination of cover layer thicknesses be no greater than about 0.125 inches, more preferably, no greater than about 0.105 inches, and most preferably, no greater than about 0.09 inches.

Any one of the at least three cover layers preferably has a thickness of less than about 0.05 inches, and more preferably, between about 0.010 inches and about 0.045 inches. Most preferably, the thickness of any one of the layers is between about 0.02 inches and about 0.04 inches.

Referring to FIG. 1, in one embodiment of the present invention the golf ball 10 includes a core 12, an inner cover layer 14, an intermediate layer 16, and an outer cover layer 18.

The inner cover can include any materials known to those of ordinary skill in the art, including thermoplastic and thermosetting materials, but preferably include ionic copolymers of ethylene and an unsaturated monocarboxylic acid, such as SURLYN®, commercially available from E.I. DuPont de Nemours & Co., of Wilmington, Del., and IOTEK® or ESCOR®, commercially available from Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The inner cover materials of this invention can likewise be blended with homopolymeric and copolymer materials such as: (1) vinyl resins, such as those formed by the polymerization of vinyl chloride, or by the copolymerization of vinyl chloride with vinyl acetate, acrylic esters or vinylidene chloride; (2) polyolefins, such as polyethylene, polypropylene, polybutylene and copolymers, such as ethylene methylacrylate, ethylene ethylacrylate, ethylene vinyl acetate, ethylene methacrylic or ethylene acrylic acid or propylene acrylic acid and copolymers and homopolymers produced using a single-site catalyst; (3) non-elastic thermoplastics including polyesters and polyamides, such as poly(hexamethylene adipamide) and others prepared from diamines and dibasic acids, as well as those from amino acids such as poly(caprolactam); non-elastic thermoplastics, including polyethylene terephthalate, polybutylene terephthalate, polyethylene terephthalate/glycol, polyphenylene oxide resins; and blends of non-elastic thermoplastics with Surlyn®, polyethylene, ethylene copolymers, ethylene-propylene diene terpolymer, etc.; (4) thermoplastic rubbers, such as olefinic thermoplastic rubbers including blends of polyolefins with ethylene-propylene diene terpolymer; (5) thermoplastic elastomers, including block copolymers of styrene and butadiene, or isoprene or ethylene-butylene rubber, copoly(ether-amides), such as Pebax® sold by Elf-Atochem, copoly(ether-ester) block copolymer elastomers sold as Hytrel® from DuPont and Lomod® from General Electric; (6) saponified polymers and blends thereof, including saponified polymers obtained by reacting copolymers or terpolymers having a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer, such as carbon monoxide, sulfur dioxide, an anhydride, a glycidyl group and a vinyl ester with sufficient amount of an inorganic metal base; (7) co- and terpolymers containing glycidyl alkyl acrylate and maleic anhydride groups, including glycidyl alkyl acrylate and maleic anhydride groups with a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester; (8) high-crystalline acid copolymers and their ionomers, including acid copolymers or ionomer derivatives formed from an ethylene and carboxylic acid copolymer comprising about 5 to 35 wt % acrylic or methacrylic acid, wherein the copolymer is polymerized at a temperature of about 130° C. to 200° C. and a pressure of about 20,000 psi to 50,000 psi and wherein up to about 70% of the acid groups are neutralized with a metal ion; and (9) oxa acid compounds including those containing oxa moiety in the backbone having the formula:

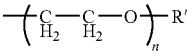

where R is an organic moiety comprising moieties having the formula:

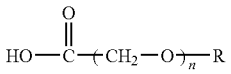

and alkyl, carbocyclic and heterocyclic groups; R' is an organic moiety comprising alkyl, carbocyclic, carboxylic acid, and heterocyclic groups; and n is an integer greater than 1. Also, R' can have the formula:

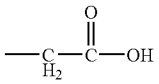

Preferably, the inner cover layers are comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the inner cover layer is preferably comprised of a polyether or polyester thermoplastic urethane, a thermoset polyurethane, an ionomer such as acid-containing ethylene copolymer ionomers, including E/X/Y copolymers where E is ethylene, X is an acrylate or methacrylate-based softening comonomer present in 0-50 weight percent and Y is acrylic or methacrylic acid present in 5-35 weight percent. The acrylic or methacrylic acid is present in an amount of about 16-35 wt %, making the ionomer a high modulus ionomer, in an amount of about 10-12 wt %, making the ionomer a low modulus ionomer, or in an amount of about 13-15 wt %, making the ionomer a standard ionomer.

Preferably, the inner cover layers include polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof.

Suitable inner cover layer compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 16 to 35 weight percent, making the ionomer a high modulus ionomer. In a higher spin embodiment, the inner cover layer includes an ionomer where an acid is present in about 10 to 15 weight percent and includes a softening comonomer.

The intermediate layers of the golf balls of the present invention are preferably formed from stiff thermoplastic polyurethanes or polyureas. The molecular structure of a typical thermoplastic urethane (TPU) consists of alternating high-melting "hard" urethane segments and liquid-like "soft" segments.

Hard segments are typically the reaction product of an aromatic or aliphatic diisocyanate and a low molecular weight, chain-extending dialcohol or diol. Suitable diisocyanates include alkyl diisocyanates, arylalkyl diisocyanates, cycloalkylalkyl diisocyanates, alkylaryl diisocyanates, cycloalkyl diisocyanates, aryl diisocyanates, cycloalkylaryl diisocyanates, all of which may be further substituted with oxygen, and mixtures thereof. The chain extender of the hard segment used in the preparation of the copolymers may be an aliphatic polyol or an aliphatic or aromatic polyamine such as known for preparing polyurethanes and polyureas. The polyol for the hard segment may be alkylene, cycloalkylene, arylene diols, triols, tetraalcohols and pentaalcohols, and mixtures thereof. The polyamine of the hard segment may be alkyl, cycloalkyl, and aryl amines that may be further substituted with nitrogen, oxygen, halogen, complexes thereof with alkali metal salts and mixtures thereof.

The hard segment can be either aromatic or aliphatic. Aromatic TPUs are commonly based on methylene diphenyl 4,4'-diisocyanate ("MDI") while aliphatic TPUs are commonly based on dicyclohexylmethane diisocyanate ("$H_{12}$MDI").

Soft segments may be built from polyols with terminal hydroxyl (—OH) groups. The hydroxyl creates a urethane group, while the reaction between isocyanates and existing urethane groups will form allophanate groups that can produce minor amounts of covalent cross-linking in TPUs. When a TPU is heated, the hydrogen-bonded hard segments and any allophanate cross-links, both of which hold the polymer together at its use temperature, dissociate to allow the polymer to melt and flow. Dissolution in a polar solvent can also disrupt the hydrogen bonds that hold together the hard segments on adjacent chains. Once these virtual cross-links are broken, the polymer can be fabricated into golf balls. Upon cooling or solvent evaporation, the hard segments de-mix from the soft segments to re-associate by hydrogen bonding. This restores the original mechanical properties of the polyurethane elastomer. Polyether and polycarbonate TPUs generally have excellent physical properties, combining high elongation and high tensile strength, albeit having fairly high-modulus. Varying the hard segment of a TPU during synthesis can produce a whole family of polymers of related chemistry but with a wide range of hardness, modulus, tensile-strength properties and elongation. In the fabrication of golf balls, the use of TPUs of different hardness values within a single family provides considerable versatility in manufacturing.

The molecular structure of a generic thermoplastic polyurea consists of a rigid "hard segment" and a flexible "soft segment. The hard segments are typically formed from the reaction product of an aromatic or aliphatic diisocyanate with an aromatic or aliphatic chain-extending diamine to form urea linkages. The soft segment may be built from amine-terminated polyethers, polyesters, polycaprolactones, polycarbonates, or other suitable long chain backbone. The reaction product of the soft segment with the hard segment, i.e., diisocyanates, produces urea linkages.

Other suitable TPUs include, but are not limited to, silicone-urethane materials such as an aromatic or aliphatic urethane hard segment with a silicone based soft segment to create a thermoplastic silicone-urethane copolymer, combining the above hard and soft segments with a polycarbonate to form a thermoplastic silicone-polycarbonate urethane copolymer, or combining the above hard and soft segments with a polyethylene oxide to form a thermoplastic silicone-polyethyleneoxide urethane copolymer.

Thermoplastic silicone-polyether urethane copolymers available today include PurSil™; silicone-polycarbonate urethane copolymers available include CarboSil™; and silicone-polyethylene oxide urethane copolymers include Hydrosil™. U.S. Pat. Nos. 5,863,627 and 5,530,083, which are incorporated by reference herein in their entirety, describe how PurSil™, CarboSil™ and Hydrosil™ are processed. The thermoplastic elastomers containing silicone in the soft segment, such as PurSil™, are prepared through a multi-step bulk synthesis. In this synthesis the hard segment is an aromatic urethane MDI (4,4'-diphenylmethane diisocyanate-butanediol) with a low molecular weight glycol extender butanediol and the soft segment is comprised of polytetramethylene oxide including polydimethylsiloxane.

In addition to polydimethylsiloxane, other suitable surface-modifying end groups, which may be used alone or in combination with one another, include hydrocarbons, fluorocarbons, fluorinated polyethers, polyalkylene oxides, various sulphonated groups, and the like. Surface-modifying end groups are surface-active oligomers covalently bonded to the base polymer during synthesis. When the aromatic or aliphatic urethane hard segment is combined with a hydrocarbon soft segment surface-modifying end group, a hydrocarbon-polyurethane is produced and has excellent properties for use in golf balls.

Thermoplastic polycarbonate-urethane copolymers are also suitable materials for the intermediate layers of the present invention and have good oxidative stability, excellent mechanical strength, and abrasion resistance. Commercially-available thermoplastic polycarbonate-polyurethane TPUs include, but are not limited to, Bionate® polycarbonate-urethanes, such as Bionate® 55D and 75D produced by the Polymer Technology Group of Berkeley, Calif.

Bionate® polycarbonate-urethane is a thermoplastic elastomer formed as the reaction product of a hydroxyl terminated polycarbonate, an aromatic diisocyanate, and a low molecular weight glycol used as a chain extender. In a preferred embodiment, polycarbonate glycol intermediate, poly (1,6-hexyl-1,2-ethyl carbonate) diol, is the condensation product of 1,6-hexanediol with cyclic ethylene carbonate. The polycarbonate macroglycol is reacted with aromatic isocyanate, 4,4'-methylene bisphenyl diisocyanate, and chain extended with 1,4-butanediol.

Ultimate tensile strengths for Bionate® compounds can exceed 10,000 psi. The ultimate elongation of the present invention is about 20 to 1000% with a preferred elongation of at least about 400 to about 800%. The initial modulus of the materials suitable for the present invention is about 300 to 150,000 psi, and preferably between about 10,000 and about 80,000 psi.

Other suitable commercially-available TPUs include the E-Series TPUs, such as D 60 E 4024 from Huntsman Polyurethanes of Germany, and TPUs sold under the tradenames of Texin® 250, Texin® 255, Texin® 260, Texin® 270, Texin® 950U, Texin® DP7-1202, Texin® 970U, Texin® 3203, Texin® 4203, Texin® 4206, Texin® 4210, Texin® 4215, and Texin® 3215, and Desmopan® 453 from Bayer of Pittsburgh, Pa.

U.S. Pat. Nos. 6,855,793, 6,739,987, and 7,037,217 disclose preferred polycarbonate-polyurethane copolymers, silicone-polyurethane copolymers, and silicone-polyurethanes, respectively, the disclosures of which are incorporated herein in their entirety by reference thereto.

The TPUs (both thermoplastic polyurethanes and thermoplastic polyureas) of the invention are also readily blended with other thermoplastic polymers, such as polycarbonates, polyvinyl chlorides, acrylonitrile-butadiene-styrenes, and polyamides. Any TPU blend, alloy or copolymer, is also suitable for the intermediate layers of the invention, such as TPU/polycarbonates; TPU/ABS; TPU/SMA (styrene-maleic anhydride); TPU/styrene-butadiene or styrene-ethylene-butadiene block copolymers; TPU/polyolefins, such as polypropylene, polyethylene, ethylene-propylene rubber ("EPR"), ethylene-propylene-diene monomer ("EPDM"), and ethylene-vinyl acetate; or TPU/modified polyolefins, such as DuPont Fusabond® functionalized (typically by maleic anhydride grafting) metallocene-catalyzed polyolefins or any other polar-group modified ethylene copolymer, such as Dow Amplify® IO, GR, or EA grade polymers.

While the inventive golf ball may be formed from a variety of differing cover materials, preferred outer cover layer materials include, but are not limited to, (1) polyurethanes, such as those prepared from polyols or polyamines and diisocyanates or polyisocyanates and/or their prepolymers, and those disclosed in U.S. Pat. Nos. 5,334,673 and 6,506,851; (2) polyureas, such as those disclosed in U.S. Pat. Nos. 5,484,870 and 6,835,794; (3) polyurethane-urea hybrids, blends or copolymers comprising urethane or urea segments; and (4) other suitable polyurethane compositions comprising a reaction product of at least one polyisocyanate and at least one curing agent are disclosed in U.S. Pat. Nos. 7,105,610 and 7,491,787, all of which are incorporated herein by reference.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Pat. No. 7,331,878, which is incorporated by reference in its entirety.

Exemplary polyisocyanates suitable for use in the outer cover layers of the invention include, but are not limited to, 4,4'-diphenylmethane diisocyanate (MDI); polymeric MDI; carbodiimide-modified liquid MDI; 4,4'-dicyclohexylmethane diisocyanate (H12MDI); p-phenylene diisocyanate (PPDI); m-phenylene diisocyanate (MPDI); toluene diisocyanate (TDI); 3,3'-dimethyl-4,4'-biphenylene diisocyanate; isophoronediisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer isocyanate groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 8.0% NCO, more preferably no greater than about 7.8%, and most preferably no greater than about 7.5% NCO with a level of NCO of about 7.2 or 7.0, or 6.5% NCO commonly used.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol;

o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2', 3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes are used to form one or more of the cover layers, preferably the outer cover layer, and may be selected from among both castable thermoset and thermoplastic polyurethanes. In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, that a catalyst may be employed to promote the reaction between the curing agent and the isocyanate and polyol, or the curing agent and the prepolymer.

Saturated diisocyanates which can be used include, without limitation, ethylene diisocyanate; propylene-1,2-diisocyanate; tetramethylene-1,4-diisocyanate; 1,6-hexamethylene-diisocyanate (HDI); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate; methyl cyclohexylene diisocyanate; triisocyanate of HDI; triisocyanate of 2,2,4-trimethyl-1,6-hexane diisocyanate. The most preferred saturated diisocyanates are 4,4'-dicyclohexylmethane diisocyanate and isophorone diisocyanate.

Saturated polyols which are appropriate for use in this invention include without limitation polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol-initiated polycaprolactone, 1,4-butanediol-initiated polycaprolactone, 1,6-hexanediol-initiated polycaprolactone; trimethylol propane-initiated polycaprolactone, neopentyl glycol initiated polycaprolactone, and polytetramethylene ether glycol-initiated polycaprolactone. The most preferred saturated polyols are polytetramethylene ether glycol and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine; ethylene diamine; diethylene triamine; triethylene tetramine; tetraethylene pentamine; 4,4'-dicyclohexylmethane diamine; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine; hexamethylene diamine; propylene diamine; 1-methyl-2,4-cyclohexyl diamine; 1-methyl-2,6-cyclohexyl diamine; 1,3-diaminopropane; dimethylamino propylamine; diethylamino propylamine; imido-bis-propylamine; isomers and mixtures of isomers of diaminocyclohexane; monoethanolamine; diethanolamine; triethanolamine; monoisopropanolamine; and diisopropanolamine. The most preferred saturated curatives are 1,4-butanediol, 1,4-cyclohexyldimethylol and 4,4'-bis-(sec-butylamino)-dicyclohexylmethane.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof. Thermosetting polyurethanes or polyureas are suitable for the outer cover layers of the golf balls of the present invention.

Additionally, polyurethane can be replaced with or blended with a polyurea material. Polyureas are distinctly different from polyurethane compositions, but also result in desirable aerodynamic and aesthetic characteristics when used in golf ball components. The polyurea-based compositions are preferably saturated in nature.

Without being bound to any particular theory, it is now believed that substitution of the long chain polyol segment in the polyurethane prepolymer with a long chain polyamine oligomer soft segment to form a polyurea prepolymer, improves shear, cut, and resiliency, as well as adhesion to other components. Thus, the polyurea compositions of this invention may be formed from the reaction product of an isocyanate and polyamine prepolymer crosslinked with a curing agent. For example, polyurea-based compositions of the invention may be prepared from at least one isocyanate, at least one polyether amine, and at least one diol curing agent or at least one diamine curing agent.

Any polyamine available to one of ordinary skill in the art is suitable for use in the polyurea prepolymer. Polyether amines are particularly suitable for use in the prepolymer. As used herein, "polyether amines" refer to at least polyoxyalkyleneamines containing primary amino groups attached to the terminus of a polyether backbone. Due to the rapid reaction of isocyanate and amine, and the insolubility of many urea products, however, the selection of diamines and polyether amines is limited to those allowing the successful formation of the polyurea prepolymers. In one embodiment, the polyether backbone is based on tetramethylene, propylene, ethylene, trimethylolpropane, glycerin, and mixtures thereof.

Suitable polyether amines include, but are not limited to, methyldiethanolamine; polyoxyalkylenediamines such as, polytetramethylene ether diamines, polyoxypropylenetriamine, and polyoxypropylene diamines; poly(ethylene oxide capped oxypropylene) ether diamines; propylene oxide-based triamines; triethyleneglycoldiamines; trimethylolpropane-based triamines; glycerin-based triamines; and mixtures thereof. In one embodiment, the polyether amine used to form the prepolymer is JEFFAMINE® D2000 (manufactured by Huntsman Chemical Co. of Austin, Tex.).

The molecular weight of the polyether amine for use in the polyurea prepolymer may range from about 100 to about 5000. In one embodiment, the polyether amine molecular weight is about 200 or greater, preferably about 230 or greater. In another embodiment, the molecular weight of the polyether amine is about 4000 or less. In yet another embodiment, the molecular weight of the polyether amine is about 600 or greater. In still another embodiment, the molecular weight of the polyether amine is about 3000 or less. In yet another embodiment, the molecular weight of the polyether amine is between about 1000 and about 3000, and more preferably is between about 1500 to about 2500. Because lower molecular weight polyether amines may be prone to forming solid polyureas, a higher molecular weight oligomer, such as JEFFAMINE® D2000, is preferred.

As briefly discussed above, some amines may be unsuitable for reaction with the isocyanate because of the rapid reaction between the two components. In particular, shorter chain amines are fast reacting. In one embodiment, however, a hindered secondary diamine may be suitable for use in the prepolymer. Without being bound to any particular theory, it is believed that an amine with a high level of stearic hindrance, e.g., a tertiary butyl group on the nitrogen atom, has a slower reaction rate than an amine with no hindrance or a low level of hindrance. For example, 4,4'-bis-(sec-butylamino)-dicyclohexylmethane (CLEARLINK® 1000) may be suitable for use in combination with an isocyanate to form the polyurea prepolymer.

Any isocyanate available to one of ordinary skill in the art is suitable for use in the polyurea prepolymer. Isocyanates for use with the present invention include aliphatic, cycloaliphatic, araliphatic, aromatic, any derivatives thereof, and combinations of these compounds having two or more isocyanate (NCO) groups per molecule. The isocyanates may be organic polyisocyanate-terminated prepolymers. The isocyanate-containing reactable component may also include any isocyanate-functional monomer, dimer, trimer, or multimeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic, aromatic, or linear or branched hydrocarbon moiety containing from about 1 to about 20 carbon atoms. The diisocyanate may also contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of diisocyanates that can be used with the present invention include, but are not limited to, substituted and isomeric mixtures including 2,2'-, 2,4'-, and 4,4'-diphenylmethane diisocyanate; 3,3'-dimethyl-4,4'-biphenylene diisocyanate; toluene diisocyanate; polymeric MDI; carbodiimide-modified liquid 4,4'-diphenylmethane diisocyanate; para-phenylene diisocyanate; meta-phenylene diisocyanate; triphenyl methane-4,4'- and triphenyl methane-4,4'-triisocyanate; naphthylene-1,5-diisocyanate; 2,4'-, 4,4'-, and 2,2-biphenyl diisocyanate; polyphenyl polymethylene polyisocyanate; mixtures of MDI and PMDI; mixtures of PMDI and TDI; ethylene diisocyanate; propylene-1,2-diisocyanate; tetramethylene-1,2-diisocyanate; tetramethylene-1,3-diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4' dicyclohexylmethane diisocyanate; 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate; para-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

Examples of saturated diisocyanates that can be used with the present invention include, but are not limited to, ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4' dicyclohexylmethane diisocyanate; 2,4-hexahydrotoluene diisocyanate; 2,6-hexahydrotoluene diisocyanate; and mixtures thereof. Aromatic aliphatic isocyanates may also be used to form light stable materials. Examples of such isocyanates include 1,2-, 1,3-, and 1,4-xylene diisocyanate; meta-tetramethylxylene diisocyanate; para-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof. In addition, the aromatic aliphatic isocyanates may be mixed with any of the saturated isocyanates listed above for the purposes of this invention.

The number of unreacted NCO groups in the polyurea prepolymer of isocyanate and polyether amine may be varied to control such factors as the speed of the reaction, the resultant hardness of the composition, and the like. For instance, the number of unreacted NCO groups in the polyurea prepolymer of isocyanate and polyether amine may be less than about 14 percent. In one embodiment, the polyurea prepolymer has from about 5 percent to about 11 percent unreacted NCO groups, and even more preferably has from about 6 to about 9.5 percent unreacted NCO groups. In one embodiment, the percentage of unreacted NCO groups is about 3 percent to about 9 percent. Alternatively, the percentage of unreacted NCO groups in the polyurea prepolymer may be about 7.5 percent or less, and more preferably, about 7 percent or less. In another embodiment, the unreacted NCO content is from about 2.5 percent to about 7.5 percent, and more preferably from about 4 percent to about 6.5 percent.

When formed, polyurea prepolymers may contain about 10 percent to about 20 percent by weight of the prepolymer of free isocyanate monomer. Thus, in one embodiment, the polyurea prepolymer may be stripped of the free isocyanate monomer. For example, after stripping, the prepolymer may contain about 1 percent or less free isocyanate monomer. In another embodiment, the prepolymer contains about 0.5 percent by weight or less of free isocyanate monomer.

The polyether amine may be blended with additional polyols to formulate copolymers that are reacted with excess isocyanate to form the polyurea prepolymer. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking the polyurea prepolymer with a single curing agent or a blend of curing agents. The curing agent of the invention is preferably an amine-terminated curing agent, more preferably a secondary diamine curing agent so that the composition contains only urea linkages. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5; dimethylthio-2,4-toluenediamine; 3,5-dimethylthio-2,6-toluenediamine; 3,5-diethylthio-2,4-toluenediamine; 3,5;

diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis (2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Any of the above inner, intermediate, or outer cover layer materials may also comprise additives known in the art, such as anti-oxidants, dyes, pigments, colorants, stabilizers, flame retardants, drip retardants, crystallization nucleators, metal salts, antistatic agents, plasticizers, lubricants, and combinations comprising two or more of the foregoing additives. Effective amounts are typically less than 5 wt %, based on the total weight of the composition, preferably 0.25 wt % to 2 wt %.

The layer compositions may also comprise fillers, including reinforcing fillers. Exemplary fillers include small particle minerals (e.g., clay, mica, talc, and the like), glass fibers, nanoparticles, organoclay, and the like and combinations comprising one or more of the foregoing fillers. Fillers are typically used in amounts of 5 wt % to 50 wt %, based on the total weight of the composition.

An optional filler component may be chosen to impart additional density to blends of the previously described components. The selection of such filler(s) is dependent upon the type of golf ball desired (i.e., one-piece, two-piece multi-component, or wound). Examples of useful fillers include zinc oxide, barium sulfate, calcium oxide, calcium carbonate and silica, as well as the other well known corresponding salts and oxides thereof. Additives, such as nanoparticles, glass spheres, and various metals, such as titanium and tungsten, can be added to the polyurethane compositions of the present invention, in amounts as needed, for their well-known purposes. Additional components which can be added to the polyurethane composition include UV stabilizers and other dyes, as well as optical brighteners and fluorescent pigments and dyes. Such additional ingredients may be added in any amounts that will achieve their desired purpose.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Due to the very thin nature, it has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

The castable, reactive liquid employed to form the urethane elastomer material can be applied over the core using a variety of application techniques such as spraying, dipping, spin coating, or flow coating methods which are well known in the art. An example of a suitable coating technique is that which is disclosed in U.S. Pat. No. 5,733,428, the disclosure of which is hereby incorporated by reference in its entirety by reference thereto.

The outer cover is preferably formed around the core and intermediate cover layers by mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. Suitable viscosity range of the curing urethane mix for introducing cores into the mold halves is determined to be approximately between about 2,000 cP and about 30,000 cP, with the preferred range of about 8,000 cP to about 15,000 cP.

To start the outer cover formation, mixing of the prepolymer and curative is accomplished in a motorized mixer including mixing head by feeding through lines metered amounts of curative and prepolymer. Top preheated mold halves are filled and placed in fixture units using pins moving into holes in each mold. After the reacting materials have resided in top mold halves for about 40 to about 80 seconds, a core is lowered at a controlled speed into the gelling reacting mixture. At a later time, a bottom mold half or a series of bottom mold halves have similar mixture amounts introduced into the cavity.

A ball cup holds the ball core through reduced pressure (or partial vacuum). Upon location of the coated core in the halves of the mold after gelling for about 40 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

Similarly, U.S. Pat. Nos. 5,006,297 and 5,334,673 both disclose suitable molding techniques which may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety.

Other methods of molding include reaction injection molding (RIM) where two liquid components are injected into a mold holding a pre-positioned core. The liquid components react to form a solid, thermoset polymeric composition, typically a polyurethane or polyurea.

The golf balls of the present invention typically have a COR of greater than about 0.775, preferably greater than about 0.795, and more preferably greater than about 0.800. The golf balls also typically have an Atti compression of at least about 40, preferably from about 50 to 120, and more preferably from about 60 to 110. As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When the Atti Gauge is used to measure cores having a diameter of less than 1.680 inches, it should be understood that a metallic or other suitable shim is used to normalize the diameter of the measured object to 1.680 inches.

It should be understood that there is a fundamental difference between 'material hardness' and 'hardness' (as measured directly on a curved surface, such as a golf ball). Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a different measurement and, therefore, many times produces a different hardness value. This difference results from a number of factors including, but not limited to, ball construction (i.e., core type, number of core and/or cover layers, etc.), ball (or sphere) diameter, and the material composition of adjacent layers (especially measuring soft, very thin layers over a layer from a harder material). It should also be understood that the two measurement techniques are not linearly related and, therefore, one hardness value cannot easily be correlated to the other. As used herein, the term "hardness" refers to hardness measured on the curved surface of the layer being measured (i.e., sphere including core+inner cover, sphere including core+inner cover+intermediate cover, or sphere including core+inner cover+intermediate cover+outer cover).

The inner cover layer has a hardness of about 45 to 68 Shore D, preferably about 50 to 62 Shore D, and more preferably about 52 to 60 Shore D. In preferred embodiments, the inner cover layer preferably has a hardness of 55 to 60 Shore D, more preferably 56 to 59 Shore D, most preferably 57 to 58 Shore D. Alternatively, the inner cover layer has a hardness of about 55 to 98 Shore C, preferably about 66 to 90 Shore C, and more preferably about 74 to 86 Shore C. In preferred embodiments, the inner cover layer preferably has a hardness of 76 to 85 Shore C, more preferably 78 to 84 Shore C, most preferably 80 to 83 Shore C.

The intermediate cover layer has a hardness of about 55 to 80 Shore D, preferably about 57 to 75 Shore D, and more preferably about 61 to 69 Shore D. Alternatively, the intermediate cover layer has a hardness of about 65 to 100 Shore C, preferably about 72 to 95 Shore C, and more preferably about 74 to 92 Shore C.

The outer cover layer has a hardness of about 35 to 65 Shore D, preferably about 40 to 62 Shore D, and more preferably about 52 to 60 Shore D. In preferred embodiments, the outer cover layer preferably has a hardness of 55 to 60 Shore D, more preferably 56 to 59 Shore D, most preferably 57 to 58 Shore D. Alternatively, the outer cover layer has a hardness of about 55 to 90 Shore C, preferably about 62 to 86 Shore C, and more preferably about 68 to 82 Shore C. In preferred embodiments, the outer cover layer preferably has a hardness of 76 to 85 Shore C, more preferably 78 to 84 Shore C, most preferably 80 to 83 Shore C.

In a particularly preferred embodiment, a golf ball is formed from a core, an inner cover layer, an intermediate cover layer, and an outer cover layer. The core is a single, solid core having an outer diameter of about 1.52 inches. The inner cover layer is formed from an ionomer and has a thickness of about 0.035 inches and a hardness of about 58 Shore D. Alternatively, the inner cover layer has a hardness of about 82 Shore C. The intermediate layer is formed from a thermoplastic polycarbonate-polyurethane copolymer and has a thickness of about 0.015 inches and a hardness of about 62 Shore D. Alternatively, the intermediate cover layer has a hardness of about 90 Shore C. The outer cover layer is formed from a thermosetting polyurea and has a thickness of about 0.030 inches and a hardness of about 57 Shore D. Alternatively, the outer cover layer has a hardness of about 80 Shore C.

The relationship between the inner cover layer, the intermediate cover layer, and the outer cover layer is also important to the golf ball of the present invention. The outer cover layer has a first hardness, the intermediate cover layer has a second hardness, and the inner cover layer has a third hardness. The non-ionomeric intermediate layer of the present invention has a hardness that is greater than the hardness of both the inner cover layer and the outer cover layer. The second hardness is at least 5 Shore D greater than the first and third hardness values, preferably at least 10 Shore D greater than the first and third hardness values, more preferably at least 15 Shore D greater than the first and third hardness values, and most preferably at least 20 Shore D greater than the first and third hardness values.

The core of the present invention has an Atti compression of between about 50 and about 90, more preferably, between about 60 and about 85, and most preferably, between about 70 and about 80. The outer diameter of the core is about 1.45 inches to 1.58 inches, more preferably about 1.50 inches to 1.56 inches, most preferably about 1.51 inches to 1.55 inches.

The thickness of the inner cover layer is preferably about 0.010 inches to 0.075 inches, more preferably about 0.030 inches to 0.060 inches, most preferably about 0.035 inches to 0.050 inches.

The thickness of the intermediate cover layer is preferably about 0.010 inches to 0.075 inches, more preferably about 0.030 inches to 0.060 inches, most preferably about 0.035 inches to 0.050 inches. In one alternative preferred embodiment, the thickness of the intermediate cover layer is about 0.015 inches to 0.030 inches.

The thickness of the outer cover layer is preferably about 0.005 inches to 0.045 inches, more preferably about 0.020 inches to 0.040 inches, and most preferably about 0.025 inches to 0.035 inches.

The flexural modulus of the intermediate layer on the golf balls, as measured by ASTM method D6272-98, Procedure B, is typically greater than about 55,000 psi, and is preferably from about 60,000 psi to 120,000 psi. Preferably, the intermediate layer compositions of the invention have a higher flexural modulus at a particular hardness than the inner cover layer ionomeric materials at the same hardness.

The golf ball can have an overall diameter of any size. While the United States Golf Association limits the minimum size of a golf ball to 1.680 inches, there is no maximum diameter. The golf ball diameter is preferably about 1.68 inches to 1.74 inches, more preferably about 1.68 inches to about 1.70 inches, and most preferably about 1.68 inches.

While any of the embodiments herein may have any known dimple number and pattern, a preferred number of dimples is 252 to 456, and more preferably is 330 to 392. The dimples may comprise any width, depth, and edge angle disclosed in the prior art and the patterns may comprises multitudes of dimples having different widths, depths and edge angles. Typical dimple coverage is greater than about 60%, preferably greater than about 65%, and more preferably greater than about 75%. The parting line configuration of said pattern may be either a straight line or a staggered wave parting line (SWPL). Most preferably the dimple number is 330, 332, or 392 and comprises 5 to 7 dimples sizes and the parting line is a SWPL.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising:

a core; and a cover disposed adjacent the core, the cover comprising:

a thermoplastic inner cover layer disposed about the core and having a hardness between 55 and 60 Shore D;

an outer cover layer having a hardness between 55 and 60 Shore D; and a non-ionomeric thermoplastic polyurethane or polyurea intermediate cover layer disposed between the inner and outer cover layers, the intermediate cover layer having a hardness greater than the inner cover layer hardness and the outer cover layer hardness;

wherein the intermediate layer hardness is 80 Shore D to 90 Shore D, the inner cover comprises a fully-neutralized ionomer and the outer cover layer comprises a polyurethane, a polyurea, or a urethane-urea blend.

2. The golf ball of claim 1, wherein the intermediate layer hardness is greater than the inner cover layer hardness and greater than the outer cover layer hardness by at least 5 Shore D.

3. The golf ball of claim 2, wherein the intermediate layer hardness is greater than the inner cover layer hardness and greater than the outer cover layer hardness by at least 10 Shore D.

4. The golf ball of claim 1, wherein the polyurethane, polyurea, or urethane-urea blend is a castable thermoset or reaction injection moldable thermoset.

5. The golf ball of claim 1, wherein the outer cover comprises a castable thermoset polyurea, the inner cover layer comprises an ionomer blend of two or more ionomers having differing metal cations, and the intermediate cover layer comprises a polycarbonate-polyurethane, a polycarbonate-polyurea, or a polycarbonate blend with polyurethane or polyurea.

6. The golf ball of claim 1, wherein the core comprises a center and at least one outer core layer.

7. The golf ball of claim 1, wherein the center is a single solid layer formed from a homogeneous composition.

8. The golf ball of claim 1, wherein the non-ionomeric thermoplastic polyurethane or polyurea intermediate layer further comprises a polyolefin, a polyamide, or an acrylonitrile-butadiene-styrene polymer.

9. The golf ball of claim 1, wherein the outer cover comprises a thermoplastic polyurethane, the inner cover layer comprises an ionomer blend of two or more ionomers having differing metal cations, and the intermediate cover layer comprises at least one thermoplastic silicone-polyurethane or thermoplastic silicone-polyurea.

10. The golf ball of claim 1, wherein the thermoplastic inner cover layer further comprises polyolefins, metallocenes, polyesters, polyamides, thermoplastic elastomers, copolyether-amides, copolyether-esters, or mixtures thereof.

11. The golf ball of claim 1, wherein a combination of the inner cover, the intermediate cover, and the outer cover have a total thickness of 0.125 inches or less.

12. The golf ball of claim 10, wherein the total thickness is 0.115 inches or less.

13. The golf ball of claim 1, wherein the outer cover layer hardness is less than the inner cover layer hardness.

14. A golf ball comprising:

a core; and a cover disposed adjacent the core, the cover comprising:

an ionomeric thermoplastic inner cover layer disposed about the core and having a hardness of 55 Shore D to 60 Shore D;

a castable thermoset outer cover layer having a hardness between 55 Shore D and 60 Shore D; and a non-ionomeric thermoplastic intermediate cover layer disposed between the inner and outer cover layers and having a hardness of 80 Shore D to 90 Shore D and greater than the inner cover layer and the outer cover layer;

wherein the inner cover layer has a first thickness, the outer cover layer has a second thickness, and the intermediate cover layer has a third thickness less than the first or second thickness by at least 20%.

* * * * *